US009093783B2

(12) United States Patent
Grimm

(10) Patent No.: US 9,093,783 B2
(45) Date of Patent: Jul. 28, 2015

(54) ELECTRICAL PLUG CONNECTION, IN PARTICULAR CIRCULAR PLUG CONNECTION

(75) Inventor: Michael Grimm, Mosbach (DE)

(73) Assignee: AMPHENOL-TUCHEL ELECTRONICS GMBH, Heilbronn (DE)

( * ) Notice: Subject to any disclaimer, the term of this patent is extended or adjusted under 35 U.S.C. 154(b) by 185 days.

(21) Appl. No.: 13/643,630

(22) PCT Filed: Apr. 20, 2011

(86) PCT No.: PCT/EP2011/002027
§ 371 (c)(1),
(2), (4) Date: Feb. 7, 2013

(87) PCT Pub. No.: WO2011/134625
PCT Pub. Date: Nov. 3, 2011

(65) Prior Publication Data

US 2013/0137287 A1 May 30, 2013

(30) Foreign Application Priority Data

Apr. 28, 2010 (DE) ..... 10 2010 018 565
Sep. 10, 2010 (DE) ..... 10 2010 045 042

(51) Int. Cl.

| | |
|---|---|
| ***H01R 4/50*** | (2006.01) |
| ***H01R 13/625*** | (2006.01) |
| ***H01R 13/639*** | (2006.01) |
| ***H01R 24/00*** | (2011.01) |
| *H01R 13/627* | (2006.01) |

(52) U.S. Cl.
CPC ..... *H01R 13/625* (2013.01); *H01R 13/639* (2013.01); *H01R 24/005* (2013.01); *H01R 13/6275* (2013.01)

(58) Field of Classification Search
USPC ..... 439/345, 310, 314, 318, 357, 372, 352, 439/541.5
See application file for complete search history.

(56) References Cited

U.S. PATENT DOCUMENTS

| | | | | |
|---|---|---|---|---|
| 4,003,622 | A | 1/1977 | Gartland, Jr. | |
| 5,685,730 | A | 11/1997 | Cameron et al. | |
| 7,632,126 | B1 * | 12/2009 | Farole et al. | 439/314 |
| 7,892,042 | B2 * | 2/2011 | Spicer et al. | 439/681 |
| 2003/0100213 | A1 | 5/2003 | Yoshigi et al. | |
| 2006/0240698 | A1 | 10/2006 | Sanuki et al. | |
| 2009/0163066 | A1 | 6/2009 | Vanzo et al. | |

* cited by examiner

*Primary Examiner* — Jean F Duverne
(74) *Attorney, Agent, or Firm* — Blank Rome LLP

(57) ABSTRACT

The invention relates to an electrical plug connection, preferably a circular plug connection having a first circular plug connector and a fastening ring. The fastening ring is rotatably arranged on the first circular plug connector. Furthermore a second circular plug connector, a primary lock and a secondary lock having a locking ring that can be placed onto the second circular plug connector are provided. The secondary lock is formed by the fastening ring and the locking ring being in locking engagement when the first circular plug connector and the second circular plug connector form the plug connection.

13 Claims, 6 Drawing Sheets

ELECTRICAL PLUG CONNECTION, IN PARTICULAR CIRCULAR PLUG CONNECTION

REFERENCE TO RELATED APPLICATIONS

This patent application is a national stage of PCT/EP2011/002027, filed Apr. 20, 2011, which claims priority to German patent application Nos. 10 2010 018 565.5 filed on Apr. 28, 2010 and 10 2010 045 042.1 filed Sep. 10, 2010, the entire disclosures of which are incorporated herein by reference.

The invention relates to an electrical connection and in particular to an electrical circular connection (plug connection). Circular connections frequently use locking means which are intended to prevent the release of the connection. These locking means are typically fixedly mounted at the respective connectors. In general, different types of connectors have to be manufactured because some connectors are used which require safety means but others are used which do not require safety means. The situation results in high production cost inasmuch as two different product lines have to be developed and also have to be maintained. The safety means are typically spring-like arrangements which are in engagement with respective openings and thus achieve the locking of two parts of a circular connection.

Moreover, circular connections are known which use the so-called bayonet locking means to maintain the connection. This kind of locking means has the advantage that of a fast and precise contacting effect.

An object of the present invention is to provide a connection, in particular a circular connection, with mountable and demountable locking means which can be manufactured easily and at a low-cost but also provide a fast, precise, and safe contact.

In accordance with the present invention this object is achieved by providing means as set forth in claim 1 as well as system as claimed in claim 14. Further modifications of the invention can be gathered from the respective dependent claims.

A further object of the invention is to provide a circular connection which combines the advantages of a bayonet locking means with spring-like modular locking of the components of a circular connection.

In particular, the present invention has the object to provide a plug connector system comprising a plug connector and a socket connector, locked by means of a bayonet lock such that the plug system can not be opened without the intention to open it and it can be opened only by means of a tool.

In accordance with the invention, a ring is provided having a spring-like element preferably made of plastic material, said ring being shifted over a flange of the socket connector and locked on the flange. Thus, locking of a circular connection is achieved which avoids an unintended opening of the connection but does not increase the size of the connection. After the plug connection is closed the spring element comes into engagement with a recess of the ring thus making an unintended opening connection impossible. The spring element (spring arm) can be disengaged by an axial pressure onto the spring arm so that the connection can be opened. An alternative design is such that only by a radial pressure by means of a tool onto the spring arm, the spring arm can be moved out of engagement. The system of the invention will be used with connectors with bayonet locking means thus combining the advantages of the bayonet locking means with the advantages of the locking by means of a spring arm.

In particular an electric connection, preferably a circular connection having a primary locking means and a secondary locking means, is provided which comprises a first circular connector (plug connector, male connector) with a mounting ring which is rotatably arranged on said first circular connector. Further, a second circular connector (socket connector, female connector) is provided with a locking ring placed on the second circular connector. The mounting ring and the locking ring comes into locking engagement (forming the secondary locking means), when the first circular connector and the second circular connector form the plug connection. In this context, the releasable arrangement of the locking ring is advantageous by allowing to manufacture one or the same circular connection with or without a secondary locking means. Thus, at the first and second circular connectors no structural changes have to be made when no secondary locking means is needed.

In accordance with a further embodiment of the invention, the mounting ring can comprise at least one first plug connector side secondary locking element and the locking ring may comprise at least one socket side secondary locking element. In accordance with an alternative embodiment the at least one male side secondary locking element may comprise at least one recess and the female side secondary locking element may comprise a spring arm with a locking nose, said spring arm extending in axial direction and being adapted to be in engagement with the at least one recess thus forming the secondary locking means. By means of such an arrangement a cost-effective and safe locking of the individual components of the circular connection are guaranteed.

In a further embodiment the first circular connector may be a male connector with the mounting ring comprising at its inner surface at least one male connector side primary locking element and the second circular connector being a female circular connector comprising at its outer surface of the body of the female connector at least one female connector side primary locking element. Preferably the at least one male connector side primary locking element is at least one bayonet pin and the at least one female connector side primary locking element is a bayonet groove which is in engagement with the at least one bayonet pin and thus forms the primary locking means. Alternatively, a plurality of bayonet grooves can be provided into which a respective number of bayonet pins engages and thus provides a secure connection of the first and second circular connectors.

In accordance with a further embodiment the at least one bayonet groove may comprise at a detent end of the bayonet groove into which a least one bayonet pin can come into engagement after reaching the detent end. Thus, the safety of the connection of the two circular connectors can be increased inasmuch an inadvertent back rotation of the mounting ring is made more difficult.

In accordance with a further embodiment the body of the female connector may comprise at least one recess which allows a radial movement of the at least one spring arm.

Further, the at least one spring arm may comprise an opening into which a de-locking tool can be inserted. Alternatively, a locking ring may be provided which comprises a plurality of spring arms such that the release of the locking means by a person is made more difficult. In particular, the locking ring can comprise a recess in the area of the spring arm and the spring arm may be biased in a direction out of the recess and thus provides a pretention with respect to the mounting ring thus furthering a safe locking effect.

In a further embodiment the locking ring may abut at an abutment surface of the body of the female connector and may also abut at a locking ring abutment thus promoting a non-tilted position of the locking ring. The locking ring may be mounted on detent noses and can be locked thus preventing a rotation of the locking ring during the establishment of the plug connection.

Alternatively, a plug connector system is provided which comprises a male or plug connector and a female or socket connector. Both connectors being connected by a primary locking means and secondary locking means. The primary locking means is preferably a bayonet connection and the secondary locking means is formed by a locking ring which can be mounted on the female connector and a rotatably mounted mounting ring provided on the male connector.

The invention will now be described referring to embodiments of the invention by reference to the drawings.

Figure 1:
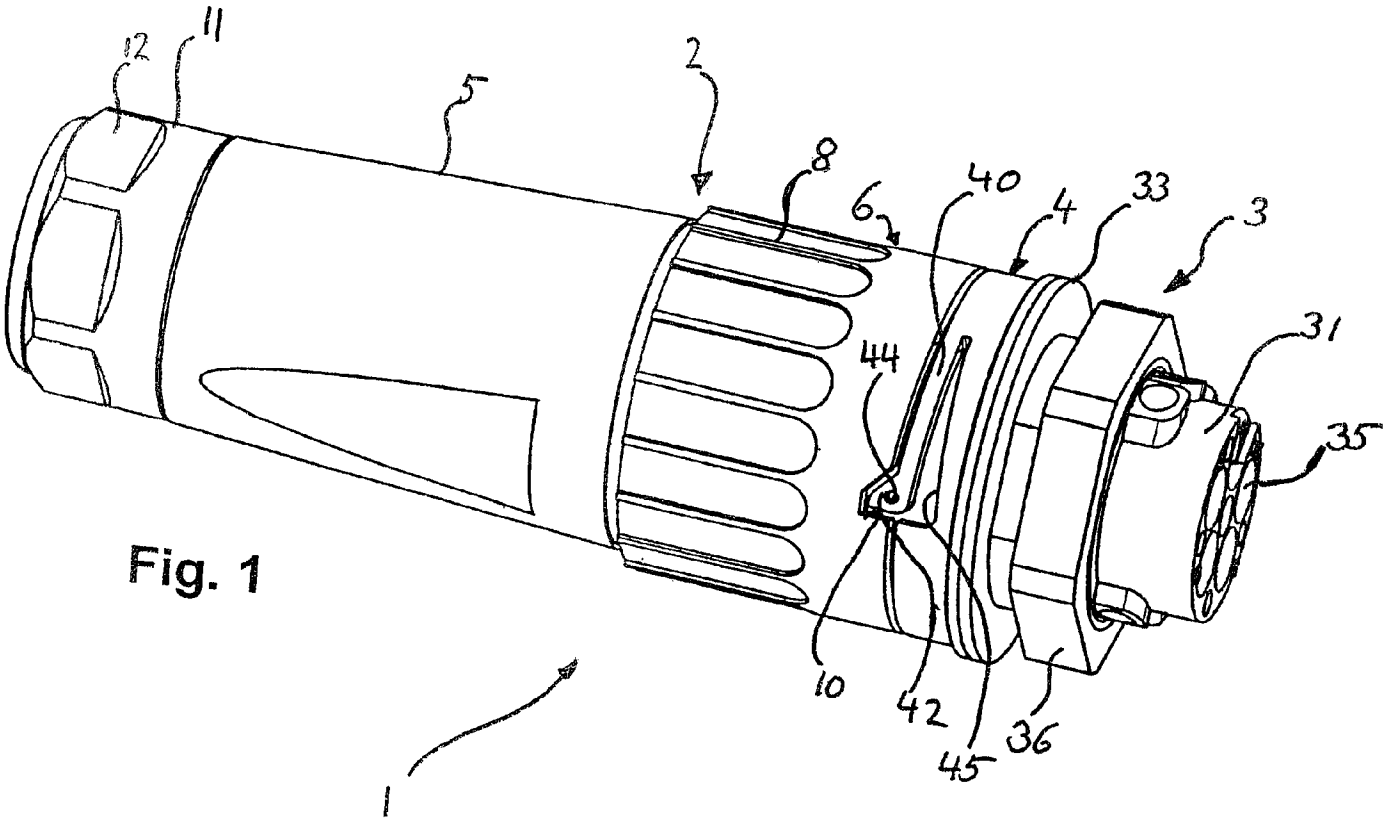
FIG. 1 is a perspective side view of a first embodiment of a plug connector system, in particular of a circular plug connection with a first circular connector and a second circular connector and a locking ring of a first design.

In the following description, references to locations or directions relate primarily to what is shown in the drawings and should not be considered limiting.

The indication with respect to location and direction may also relate to a preferred arrangement.

The circular connection 1 of FIG. 1 comprises a first circular connector 2 also referred to as a plug connector (male connector) and a second circular connector 3 preferably in the form of a female connector which can be connected to a cable. The plug connector 2 can be called a cable plug connector.

Figure 6:
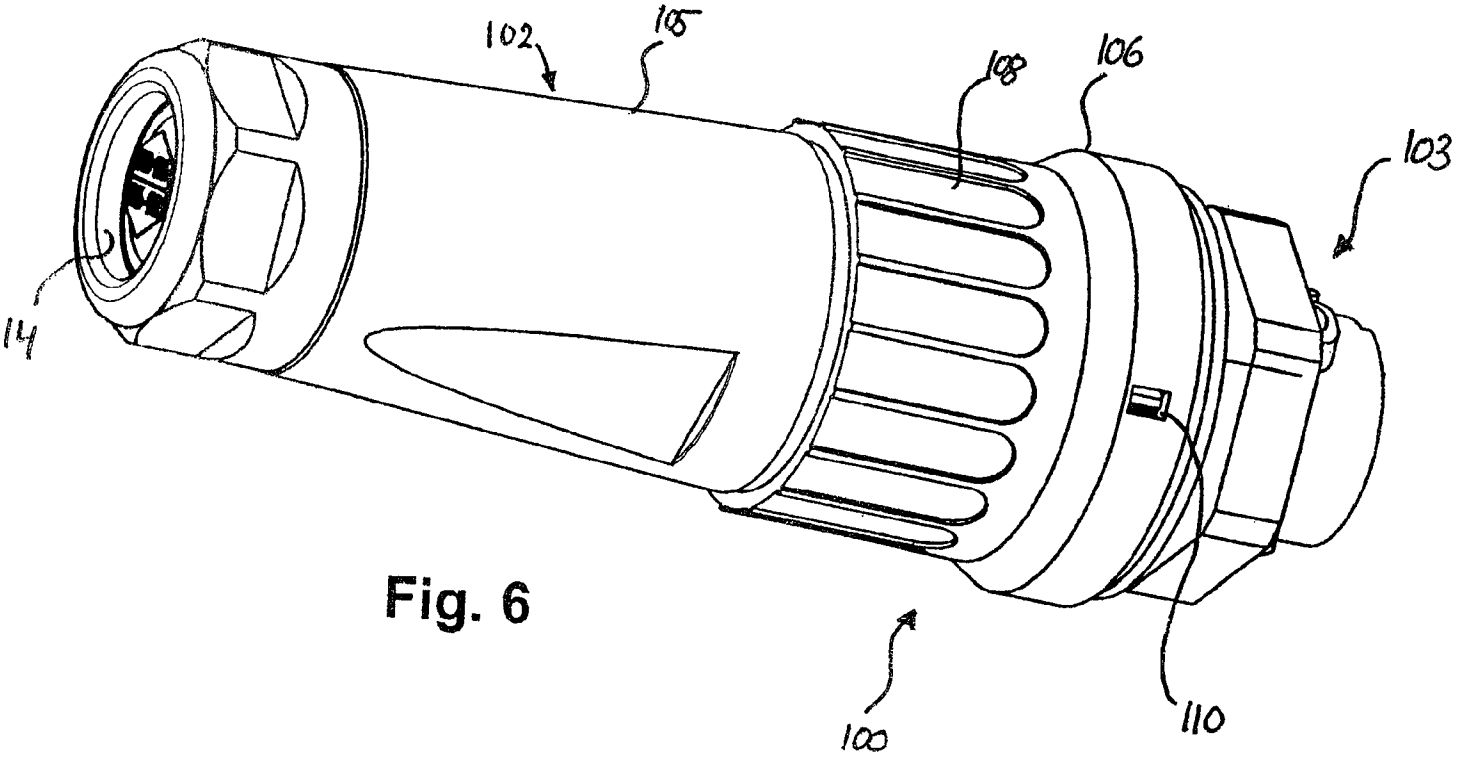
FIG. 6 is a perspective side view of a second embodiment of a circular connection with a first circular connector and a second circular connector.

The plug connection of the first circular connector 2 with the second circular connector 3 is maintained by a primary locking means preferably a bayonet locking means and a secondary locking means. The secondary locking means preferably uses a locking ring 4 which is preferably made of plastic material. The first or circular plug connector 2 comprises a plug connector housing 5 onto which a mounting ring 6 is mounted at the plug side end of the plug connector 2. The mounting ring 6 comprises at its inner side a primary locking element located at the plug connector but not shown in the drawings. The primary locking element is in particular a first bayonet element, in particular a bayonet pin not shown. The plug connector side primary locking element forms together with a female connector locking element the primary locking means. Further, at the upper surface of the mounting ring 6 recesses 8 are provided. Towards the plug side end of the plug connector the mounting ring 6 is provided with a plug connector side secondary locking element preferably in the form of a recess 10. Further, at the plug connector 2 a mounting ring 11 is provided at the cable side end thereof. The mounting ring 11 can effect preferably a clamping effect on a connecting cable not shown. At a surface of the mounting ring flat recesses 12 are provided which might come into engagement with a tool for rotation. Moreover, the mounting ring 11 comprises an opening 14 to receive the connecting cable. The opening 14 is shown in FIG. 6.

Figure 2:
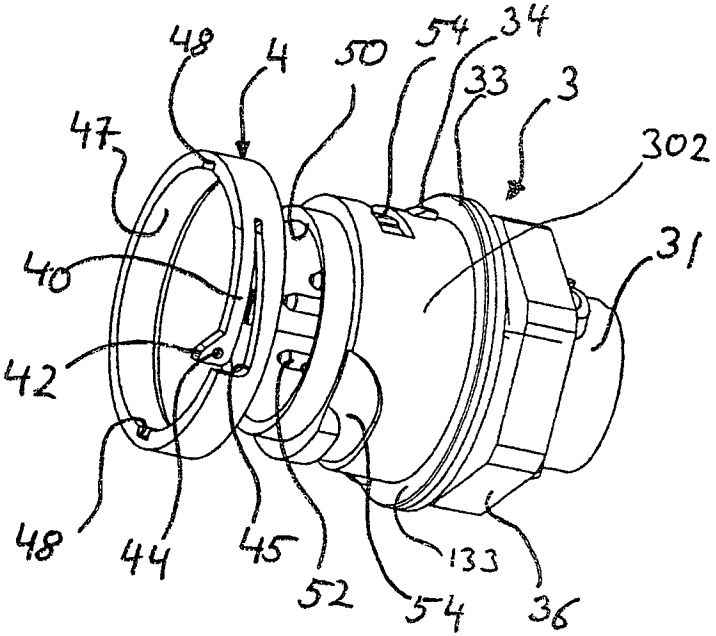
FIG. 2 is a perspective side view of a locking ring of the first design and of the second circular connector of FIG. 1.
Figure 5:
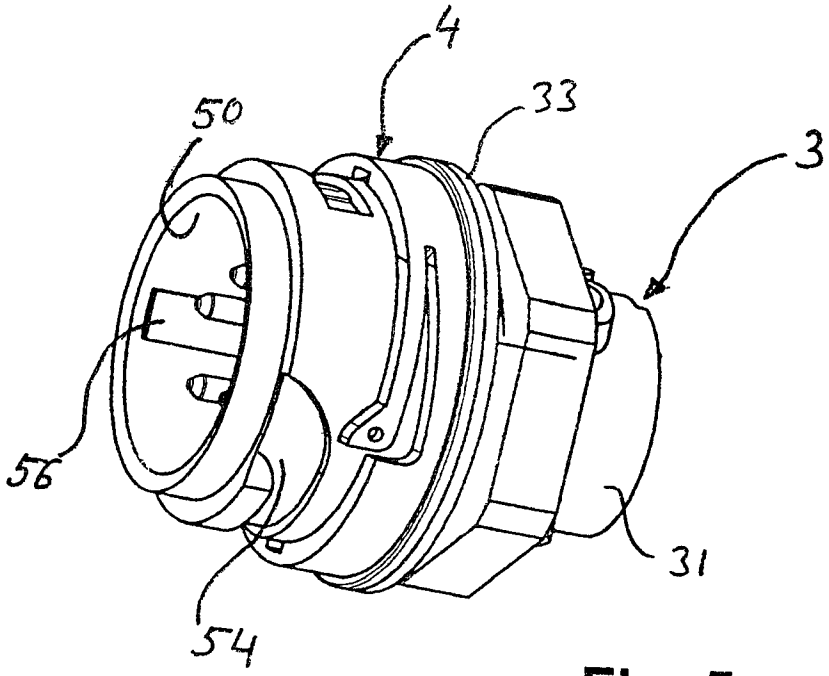
FIG. 5 is a perspective side view of a second circular connector with a locking ring of FIG. 1 mounted thereon.

In FIG. 1 and in particular in FIGS. 2 and 5 a female connector 3 is shown which comprises a female connector body 31 which comprises a radially extending locking ring abutment 33. At the right end of the female connector 3, see FIG. 1, connecting openings 35 are provided. The locking abutment 33 forms an abutment surface 133 for the locking ring 4 which is placed on an cylindrical flange 302 of the body 31 of the female connector; the primary locking element is formed in the flange 302 of the female connector side.

In the area of the flange 302 and the locking abutment 33 also detent noses 34 of the female connector side primary locking element are provided which may prevent a rotation of the locking ring 4 after the locking ring 4 is placed on the flange 302 on the body 31 of the female connector. Moreover, the female connector 3 comprises a mounting ring 36 for the body of the female connector, said ring 36 preferably comprising an inner thread which can be brought into threadable connection with the body 31 of the female connector; the inner thread is not shown in FIG. 1.

At the other end (in FIG. 2 the left end) of the female connector 3 an opening 50 is provided into which a plug-side end of the male connector 2 is inserted. Moreover, within the opening electrical contacts 52 are arranged. The housing 31 of the female connector 33 further comprises a female connector side primary locking element in particular a second bayonet element or a bayonet groove 54. The bayonet groove 54 forms together with the plug connector side primary locking element, in particular the bayonet pin, the primary locking means: As shown, the bayonet pin and the bayonet groove 54 are in engagement with each other. Preferably, a plurality of bayonet grooves 54 can be provided together with a respective number of bayonet pins.

In FIG. 1 the locking ring 4 is shown as being arranged between the male connector 2 and the female connector 3. The locking ring 4 comprises on its female connector side a secondary locking element in particular a spring arm 40. The spring arm 40 comprises a fixed end and a free end. The spring arm 40 further comprises a locking nose 42. The locking nose 42 preferably extends in axial direction and forms together with the recess 10 of the mounting ring 6 the secondary locking means of the circular connector 1. At the free end of the spring arm 40 an opening 44 is provided in which a de-locking tool can be inserted. The locking ring 4 further comprises in the area of the spring arm 40 a recess 54 which provides for an axial movement of the spring arm 40.

FIG. 2 discloses the female connector 3 with the locking ring 4 not being mounted thereon. In FIG. 2 one can further recognize that the locking ring 4 comprises at its inner side 47 detent openings 48.

Figure 3:
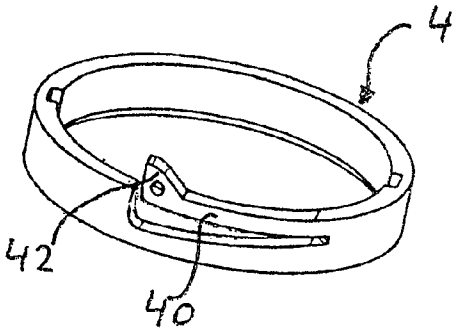
FIG. 3 is a perspective side view of the locking ring of FIG. 1.

FIG. 3 discloses the locking ring 4 with the spring arm 40 and the locking nose 42.

Figure 4:
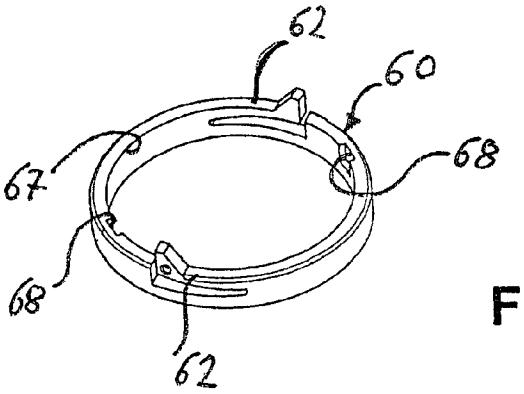
FIG. 4 is a perspective side view of a locking ring of a second design.

FIG. 4 discloses an alternative design of the locking ring 60. The locking ring 60 of similar design as the locking ring 4 but comprises two spring arms 62. The two spring arms 62 are identically formed like the spring arm 40 in FIG. 3. In this case, the mounting ring 6 comprises two oppositely located recesses 10. The locking ring 60 comprises at its inner side 67 detent openings 68.

FIG. 5 discloses the female connector 3 with the locking ring 4 mounted on the support surface thereof. The locking noses 34, preferably extending in axial direction are in engagement with the preferably slot-shaped axially or longitudinally or in plug direction extending detent openings 48 of the locking ring 4 thus making a rotation of the locking ring 4 on the female connector 3 impossible. Further, in accordance with FIG. 5, within the opening 50 of the female connector 3 an index projection 56 is provided. The index projection 56 makes it impossible, that an erroneous connection between the male connector 2 and the female connector 3 occurs.

FIG. 6 discloses a second embodiment of a circular connector 100. The circular connector 100 comprises a male connector (first circular connector) 100, a female connector (second circular connector) 103 and a locking ring 104 shown in FIG. 7. On a housing 105 of the male connector a mounting ring 106 is arranged. The mounting ring 106 comprising at its upper surface recesses 108. The mounting ring 106 further comprises, but not shown in FIG. 6, a plug connector, (first circular connector) primary locking element, in particular a first bayonet element, i.e. a bayonet pin. At the plug side end of the mounting ring 106 a plug side secondary locking element is provided, in particular a recess 110. The recess 110 extends in radial direction, preferably a hole is formed in the mounting ring 106.

The female side primary locking element of the female or first circular connector 103 forms together with the male connector side primary locking element the primary locking means.

Figure 7:
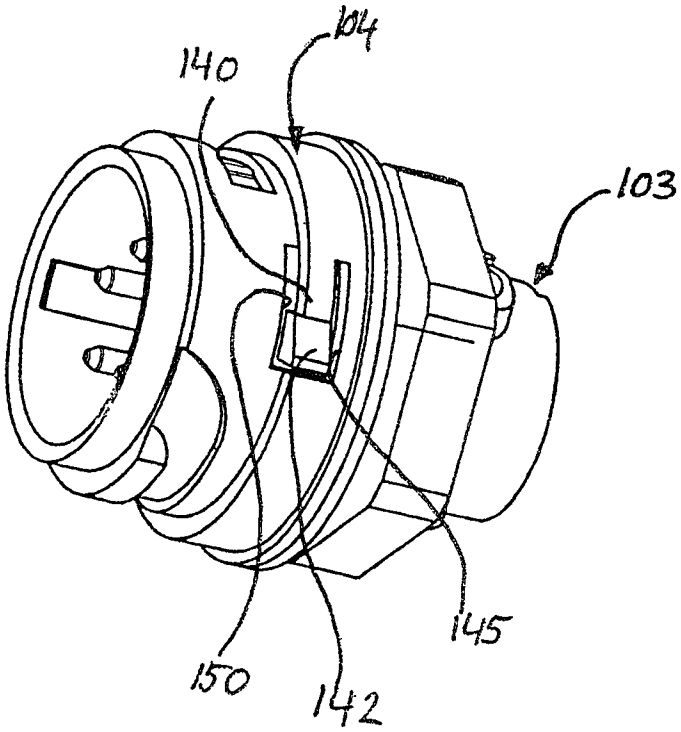
FIG. 7 is a perspective side view of the second circular connector of FIG. 6 with a locking ring of the second embodiment.

FIG. 7 discloses the female connector 103 with a locking ring 104 mounted thereon. The locking ring 104 comprises like the locking ring 4 at its inner side detent openings which are however not shown in FIG. 7. Further, the locking ring 104 comprises a female connector side secondary locking element in particular the spring arm 140. The spring arm 140 comprises further a fixed end and a free end. At the free end a locking nose 142 is provided. In the area of the spring arm 140 the locking ring 104 comprises further a recess 145. The locking noses 142 form together with the recess 110 a secondary locking means of the circular connection 110.

The female connector 103 is in substance designed like the female connector 3 of the first embodiment, comprises however in the area of the spring arm 140 a recess 150. This recess 150 allows the radial movement of the spring arm 140 so that the spring arm can come into engagement with the recess 110 at the time the male connector 102 is mounted and the mounting ring 106 is rotated.

The primary locking means of the second embodiment is identical to the first embodiment.

The following description is directed in substance to FIGS. 1 and 2 so as to describe the plug connection of the male, i.e. first circular connector, 2 with the female, i.e. second circular connector, 3.

14. The male connector 2 is placed with the mounting ring 6 on the body 31 of the female connector. In this process the bayonet pins which are located on the inner side of the mounting ring 6 come into engagement with the bayonet groove of the female connector 3. By rotating the mounting ring 6, the bayonet pin moves in the bayonet groove 45 thus effecting the primary locking means of the male connector with the female connector 3. Between the male connector 2 and the female connector 3 the locking ring 4 is located, which is locked with its locking openings 48 on the locking noses 34 of the female connector 3 such that a rotation of the locking ring is not possible. When the bayonet pins of the male connector 2 arrive at the end of the bayonet groove 45 the bayonet nose 42 of the spring arm 40 of the locking ring 4 comes into locking engagement with the recess 10 of the mounting ring 6 thus the secondary locking means between the male connector 2 and the female connector 3 becomes effective. In case the locking connection has to be opened, then it is necessary to introduce a tool into the opening 54 of the spring arm 40 and the spring arm 40 is actually moved out of the recess 10 and thus a rotation of the male connector 2 in a direction opposite to the preceding rotary movement is possible and the plug connection can be released.

Providing a plug connection for the second embodiment is in substance identical to the above explained process, however, the spring arm 142 in FIG. 7 does not move axially as in the first embodiment but radially as soon as the bayonet pin of the primary locking reaches the end of the bayonet groove to come into engagement with the recess 110. For releasing this plug connection, the spring arm 142 has to be moved by means of a suitable tool radially in the opening 150 of the female connector 103 and thus a release of the plug connection can be achieved by setting the recess 110 free.

The invention claimed is:

1. An electric plug connection comprising:

a first circular connector with a mounting ring, rotatably mounted on the first circular connector, a second circular connector, a primary locking means, and a secondary locking means said secondary locking means comprising a locking ring mounted on the second circular connector, said secondary locking means being formed by locking engagement of the mounting ring and the locking ring when said first circular connector and second circular connector form the plug connection;

wherein the locking ring comprises a recess which is adapted to engage a spring arm which is biased and bent out of the recess.

2. An electric plug connection as set forth in claim 1, wherein the mounting ring comprises at least one plug side secondary locking element and that the locking ring comprises at least one female side secondary locking element.

3. An electric plug connection as set forth in claim 2, wherein the at least one plug side secondary locking element comprises a recess and the female side secondary locking element comprises at least one spring arm having a locking nose which is in engagement with the at least one recess and thus form the secondary locking means.

4. An electric plug connection as at forth in claim 1, wherein the first circular connector is a male connector and that the mounting ring comprises at an inner surface at least one plug side primary locking element.

5. An electric plug connection as set forth in claim 1, wherein the second circular connector is a female connector and at an outer surface of a body of the female connector at least one female connector side primary locking element is provided.

6. An electric plug connection as set forth in claim 5, wherein at least one of the plug connector side primary locking element comprises a bayonet pin and that the at least one female connector side primary locking element comprises at least one bayonet groove which is in engagement with the at least one bayonet pin, thus forming the primary locking means.

7. An electric plug connection as set forth in claim 6, wherein the at least one bayonet groove comprises at a detent end a detent with the at least one bayonet pin can come into engagement when reaching the detent end.

8. An electric plug connection as set forth in claim 5, wherein the body of the female connector, comprises at least one recess which allows a radial movement of an at least one spring arm.

9. An electric plug connection as set forth in claim 8, wherein the at least one spring arm comprises an opening in which a de-locking tool can be inserted.

10. An electric plug connection as set forth in claim 1, wherein the locking ring comprises two spring arms with each one having a locking nose and the mounting ring comprises two recesses which are in engagement with the locking noses.

11. An electric plug connection as set forth in claim 5, wherein the locking ring is located on an abutment surface of the body of the female connector and thus is in abutment with the locking ring abutment.

12. An electric plug connection as set forth in claim 11, wherein the abutment surface comprises detent noses which allow a fixedly location of the locking ring.

13. A plug system comprising:

a male apparatus connector, a female cable connector, a primary locking means, and a secondary locking means wherein the primary locking means comprises a bayonet locking means and the secondary locking means is formed by a locking or mounting ring adapted to be placed on the female connector, and a locking ring rotatably mounted on the male apparatus connector, wherein one of the locking rings comprises a recess which is adapted to engage a spring arm on the other locking ring.

* * * * *